US007880078B2

(12) United States Patent
Nishida

(10) Patent No.: US 7,880,078 B2
(45) Date of Patent: Feb. 1, 2011

(54) ELECTRONIC KEYBOARD INSTRUMENT

(75) Inventor: Kenichi Nishida, Hamamatsu (JP)

(73) Assignee: Yamaha Corporation (JP)

( * ) Notice: Subject to any disclaimer, the term of this patent is extended or adjusted under 35 U.S.C. 154(b) by 486 days.

(21) Appl. No.: 11/858,541

(22) Filed: Sep. 20, 2007

(65) Prior Publication Data

US 2008/0072742 A1 Mar. 27, 2008

(30) Foreign Application Priority Data

Sep. 21, 2006 (JP) ..... 2006-255482

(51) Int. Cl.
*G10H 1/00* (2006.01)
*G10H 1/18* (2006.01)
*G10H 7/00* (2006.01)

(52) U.S. Cl. ..... 84/615; 84/719; 84/721

(58) Field of Classification Search ..... 84/721, 84/746, 615, 719
See application file for complete search history.

(56) References Cited

U.S. PATENT DOCUMENTS 4,744,279 A * 5/1988 Livingston ..... 84/746
4,817,485 A * 4/1989 Bozzio et al. ..... 84/746
5,223,655 A * 6/1993 Watanabe et al. ..... 84/637
5,241,130 A * 8/1993 Shibukawa ..... 84/659
5,350,883 A * 9/1994 Kitamura et al. ..... 84/644
5,521,327 A * 5/1996 Kay et al. ..... 84/635
5,977,474 A * 11/1999 O'Brien ..... 84/735
6,624,348 B1 * 9/2003 Matsutsuka ..... 84/719
6,689,947 B2 * 2/2004 Ludwig ..... 84/721
6,979,770 B2 * 12/2005 Hampton, Jr. ..... 84/723

FOREIGN PATENT DOCUMENTS

JP 52-114728 A 9/1977
JP 02-136895 A 5/1990

(Continued)

OTHER PUBLICATIONS

Office Action issued in corresponding Japanese Patent Application No. 2006-255482 dated Oct. 14, 2010. Full English translation provided.

(Continued)

*Primary Examiner*—Jeffrey Donels
(74) *Attorney, Agent, or Firm*—Rossi, Kimms & McDowell LLP

(57) ABSTRACT

Respective sets of black keys and white keys of respective octaves of a keyboard 10 are defined as specific key range, respectively, to assign various tone colors of percussion instruments of a drum set to a plurality of keys included in the respective specific key ranges of the octaves. A specific key range has secondary key ranges to assign tone colors produced by different playing techniques of the same musical instrument. A depression of any key of a specific key range results in generation of a musical tone having a tone color of a percussion instrument assigned to the specific key range. To a pedal unit 20, a tone color of "bass drum" is assigned. Tone colors of "hi-hat" assigned to the keyboard 10 are controlled such that a depression of any key to which "hi-hat" is assigned with or without operation of the pedal unit 20 results in generation of a musical tone of open hi-hat or closed hi-hat.

19 Claims, 8 Drawing Sheets

FOREIGN PATENT DOCUMENTS

| | | | |
|---|---|---|---|
| JP | 2-179691 | A | 7/1990 |
| JP | 06-250658 | A | 9/1994 |
| JP | 8-278781 | A | 10/1996 |
| JP | 2000-56765 | A | 2/2000 |

OTHER PUBLICATIONS

Office Action issued in corresponding Japanese Patent Application No. 2006-255482 dated Nov. 16, 2010. Full English translation provided.

* cited by examiner

FIG.3

| | drum tone color menu |
|---|---|
| tone color set 1 | black keys: cowbell/cymbal/gong<br>white keys: snare/conga/triangle |
| tone color set 2 | black keys: cymbal/cymbal/cymbal/cymbal<br>white keys: hi-hat/snare/tom/floor tom |
| tone color set 3 | black keys: cymbal/cymbal/cymbal/cymbal/cymbal<br>white keys: hi-hat/snare/tom/tom/floor tom/bass drum |
| tone color set 4 | black keys: cymbal/cymbal/cymbal/cymbal/cymbal<br>white keys: open hi-hat/closed hi-hat/ ··· |
| tone color set 5 | black keys: open hi-hat/cymbal/cymbal/ ···<br>white keys: closed hi-hat/snare/tom ··· |
| tone color set 6 | black keys: cymbal/cymbal/cymbal/cymbal/cymbal<br>white keys: open hi-hat/closed hi-hat/ ··· |
| tone color set 7 | black keys: cymbal stop/cymbal/ ···<br>white keys: cymbal/cymbal stop/hi-hat/ ··· |
| tone color set 8 | black keys: cymbal/snare roll/snare rim shot/ ···<br>white keys: hi-hat/snare normal/tom/ ··· |
| | ⋮ |

FIG.4

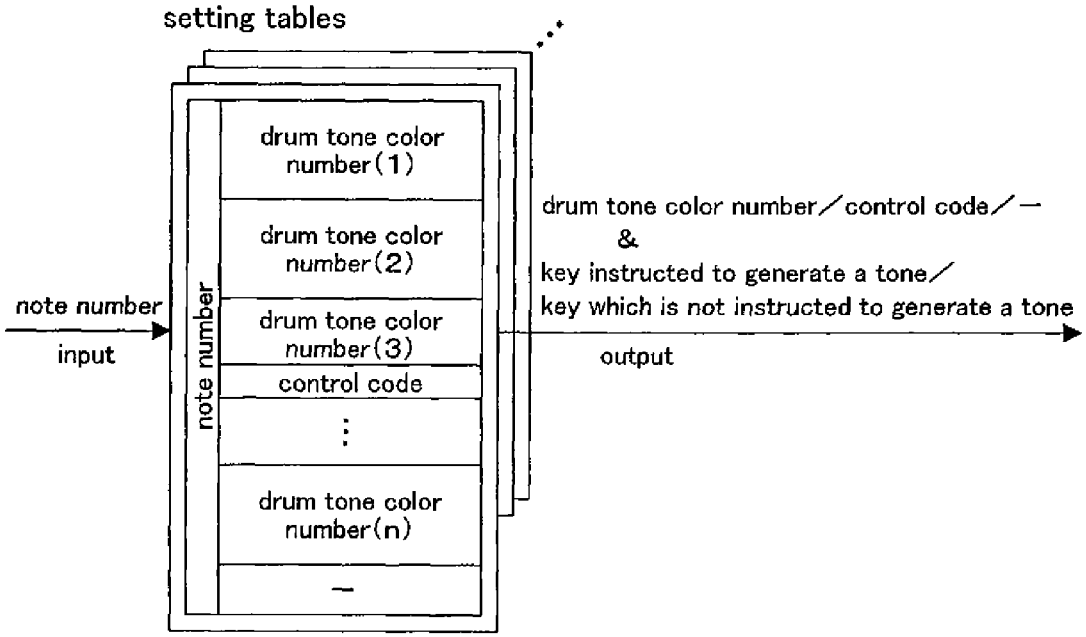

ELECTRONIC KEYBOARD INSTRUMENT

BACKGROUND OF THE INVENTION

1. Field of the Invention

The present invention relates to an electronic keyboard instrument which generates musical tone signals having tone colors of percussion instruments by user's performance on a keyboard.

2. Description of the Related Art

As disclosed in Japanese Patent Laid-Open Publication No. 2000-56765, Japanese Utility Model Publication No. S52-114728, etc., there have conventionally been electronic keyboard instruments on which various percussion instruments such as drum and cymbal are assigned to keys of their keyboard so that user's key-depressions on the keyboard result in generation of musical tone signals having tone colors of the percussion instruments such as drum and cymbal instead of the musical scale tone signals corresponding to the keys of the keyboard.

SUMMARY OF THE INVENTION

The above-described conventional electronic keyboard instruments are capable of generating musical tone signals having tone colors of percussion instruments, however, the tone colors of the percussion instruments are assigned to the keys in one-to-one correspondence, presenting a problem that the user has to be quite used to playing such conventional electronic keyboard instrument in order to enjoy drum performance on the conventional electronic keyboard instrument. Furthermore, the above-described conventional electronic keyboard instruments fail to make the user feel as if he were striking drums using his body, being susceptible to improvement in simulating drum performance.

The present invention was accomplished to solve the above-described problems, and an object thereof is to provide an electronic keyboard instrument which makes it easy for the user to do drum performance on the electronic keyboard instrument and allows the user to do drum performance as if he were striking a real drum set.

It is a feature of the present invention to provide an electronic keyboard instrument comprising a keyboard having a plurality of keys; a percussion instrument assigning portion for assigning a type of percussion instrument to a plurality of keys included in a specific key range of the keyboard; and a musical tone generation controlling portion for controlling, in a case where any of the keys included in the specific key range is depressed, generation of a musical tone signal having a tone color of the percussion instrument assigned to the specific key range which includes the depressed key. Because of this feature, depression of any of the plurality of keys included in the specific key range results in generation of a musical tone signal having the tone color of the same percussion instrument, which facilitates player's percussion performance on the electronic keyboard instrument and allows a player to feel as if he were striking real drums.

In this case, the specific key range may be provided on an octave basis, which facilitates user's recognition of the specific key range to which the same tone color is assigned. Such facilitated recognition of the specific key range makes it easy for the user to do percussion performance on the electronic keyboard instrument.

Furthermore, the specific key range may be composed of a plurality of neighboring black keys included in an octave or a plurality of neighboring white keys included in an octave. In this case, both the plurality of neighboring black keys and the plurality of neighboring white keys may be defined as specific key ranges. More specifically, the term of "or" includes a case as well in which both the black keys and the white keys are defined as specific key ranges. In other words, in an octave disposed in a certain position of the entire keys arranged in the keyboard, different percussion instruments are assigned to the specific key range of the black keys disposed on the side farther from the player and to the specific key range of the white keys disposed on the side nearer to the player, respectively, enabling percussion performance which allows player's to-and-fro striking action, which allows the player to feel as if he were striking a real drum set.

It is another feature of the present invention that in a case where a plurality of keys included in the specific key range of the keyboard are depressed concurrently or consecutively in a certain short period of time, the musical tone generation controlling portion responds only to the first key-depression to control generation of one musical tone signal. If a plurality of keys included in the specific key range are depressed concurrently or consecutively with a time difference (consecutive key-on events), in other words, only the first key-on event is enabled with subsequent key-on events within a certain time difference being disabled. Therefore, the musical generation controlling portion responds only to the first key-on event and controls generation of a musical tone signal for the first key-on event. As a result, concurrent generation of a plurality of musical tone signals is prevented to avoid muddiness of tones and reduction in loudness caused by antiphase of waveform of tones.

Furthermore, the percussion instrument assigning portion may assign a plurality of percussion instruments included in a drum set to a plurality of specific key ranges arranged in a direction of the keys of the keyboard such that the assignment of the percussion instruments to the specific key ranges corresponds with an arrangement of the drum set; and the musical tone generation controlling portion may control generation of a musical tone signal having a tone color of a percussion instrument assigned to a specific key range including the depressed key. As a result, the present invention enables percussion performance which allows player's striking action in the direction of the keys of the keyboard, allowing the player to feel as if he were playing a real drum set.

It is still another feature of the present invention that the percussion instrument assigning portion divides the specific key range into a plurality of secondary key ranges each composed of a plurality of keys, and assigns a plurality of tone colors produced by different playing techniques of the type of percussion instrument assigned to the specific key range to the secondary key ranges, respectively; and in a case where any key of the secondary key ranges is depressed, the musical tone generation controlling portion controls generation of a musical tone signal having a tone color assigned to the secondary key range which includes the depressed key. In this case, the plurality of keys included in each of the secondary key ranges may be composed of only white keys or only black keys. In a case where the specific key range is composed of "a key range of one octave", for instance, each of the secondary key ranges can be composed of "a key range of the black keys", "a key range of the white keys", "the lower two black keys", "the upper three black keys", "keys C, D and E", "keys F, G, A and B", "keys from C to E", "keys from F to B", etc. In a case where the specific key range is composed of "a key range of two octaves", in addition, each of the secondary key ranges can be composed of "the key range of the lower octave", "the key range of the upper octave", etc. More specifically, hi-hat (percussion instrument) can be assigned to one specific key range, with a tone color of open hi-hat being assigned to one secondary key range of its black keys and a tone color of closed hi-hat being assigned to the other secondary key range of its white keys. The "different playing techniques" include following cases. For example, tone colors of snare are assigned to a specific key range, with "a tone color of normal snare", "a tone color of roll", and "a tone color of rim shot" being assigned to secondary key ranges of the specific key range respectively. In another example, tone colors of hi-hat are assigned to a specific key range, with "a tone color of open hi-hat" and "a tone color of closed hi-hat" being assigned to secondary key ranges of the specific key range respectively. In still another example, snare, hi-hat, cymbal and the like are assigned to specific key ranges respectively, with a tone color produced when played with sticks and a tone color produced when played with a brush being assigned to their respective secondary key ranges. As a result, the present invention enables control of generation of musical tone signals having different tone colors played by different playing techniques of a percussion instrument assigned to a specific key range, allowing drum performance with further realistic tone colors on the electronic keyboard instrument.

It is a further feature of the present invention that the percussion instrument assigning portion allows the specific key range to further include a key to which a modification function for modifying a generation manner of a musical tone signal corresponding to the percussion instrument assigned to the specific key range is assigned; and the musical tone generation controlling portion further modifies, in a case where the key to which the modification function is assigned is depressed, the generation manner of a musical tone signal generated by a depression of any other key of the specific key range. In this case, for instance, in a case where the key to which the modification function is assigned is depressed during generation of a musical tone signal by a depression of any other key of the specific key range, the musical tone generation controlling portion changes a tone color of the musical tone signal generated by the depression of the other key and then terminates generation of the musical tone signal. Furthermore, in a case where the key to which the modification function is assigned is depressed prior to generation of a musical tone signal by a depression of any other key of the specific key range, the musical tone generation controlling portion generates a musical tone signal having a tone color different from that of a musical tone signal to be generated without depression of the key to which the modification function is assigned, and also terminates generation of the musical tone signal earlier than termination of generation of a musical tone signal to be generated without depression of the key to which the modification function is assigned. In a case where cymbal (percussion instrument) is assigned to the specific key range and a key included in the specific key range is defined as key to which the modification function is assigned, for example, if generation of a musical tone signal corresponding to the cymbal caused by a depression of any other key included in the specific key range is followed by a depression of the key to which the modification function is assigned, characteristics (tone color and/or effect to be added) of the musical tone signal corresponding to the cymbal are modified to suppress reverberation of the musical tone signal to immediately terminate the generation of the musical tone signal. If any key of the specific key range is depressed while the key to which the modification function is assigned is depressed, characteristics of a musical tone signal corresponding to the cymbal are controlled to generate a musical tone signal having a tone color of cymbal with suppressed reverberation to immediately terminate the generation of the musical tone signal. As a result, the present invention enables the player to add variety of modifications to the generation manner of a musical tone signal corresponding to a percussion instrument (e.g., variety of modifications to tone color and/or effect) only with depression of the key to which the modification function is assigned, allowing drum performance with further realistic tone colors on the electronic keyboard instrument.

It is still further feature of the present invention to provide an electronic keyboard instrument further comprising a pedal operated with a foot, wherein the musical tone generation controlling portion changes a tone color of a musical tone signal generated by a depression of a key included in the specific key range in accordance with operation of the pedal. As a result, player's pedal operation allows the player to play, on the electronic keyboard instrument, musical tones produced by a percussion instrument which includes a pedal as if he were playing a real drum set. In this case, for example, in a case where hi-hat is assigned to the keys of the specific key range by the percussion instrument assigning portion, the musical tone generation controlling portion may control such that a musical tone signal to be generated by a depression of any key of the specific key range has a tone color of open hi-hat if the pedal is not operated (off-state of the pedal operation), and the musical tone signal has a tone color of closed hi-hat if the pedal is operated (on-state of the pedal operation). In this case, if generation of a musical tone signal having a tone color of open hi-hat is followed by detection of on-state of the pedal operation, the musical tone signal of open hi-hat may be replaced with a musical tone signal having a tone color of "contact tone of closed hi-hat". In a case where the player desires to play open hi-hat and closed hi-hat, as a result, the present invention allows the player to operate the pedal of the electronic keyboard instrument as if he were operating a pedal in order to switch between open hi-hat and closed hi-hat, enabling further realistic drum performance on the electronic keyboard instrument.

It is a further feature of the present invention to provide an electronic keyboard instrument further comprising a pedal operated with a foot, wherein the musical tone generation controlling portion controls generation of a musical tone signal having a tone color of bass drum in response to operation of the pedal. In this case, the electronic keyboard instrument may further comprises a velocity sensing portion for sensing operational velocity of the pedal, wherein the musical tone generation controlling portion controls loudness of a musical tone signal to be generated in accordance with an operational velocity of the pedal sensed by the velocity sensing portion. As a result, the present invention realizes more realistic performance of percussion tones using the pedal on the electronic keyboard instrument.

It is still a further feature of the present invention to provide an electronic keyboard instrument further comprising a sequencer for recording performance of percussion tones by depression of the keys included in the specific key range, wherein the sequencer records not performance data indicative of pitch of the depressed keys but performance data indicative of the percussion instrument assigned to the specific key range. Regardless of positions of depressed keys (note numbers or key codes), more specifically, the present invention enables the sequencer to record note numbers corresponding to tone colors included in a drum kit (drum tone color group of general MIDI tone generator). In the following descriptions, "note numbers" corresponding to tone colors included in a drum kit are referred to as "drum tone color numbers" in order to distinguish from note numbers regarded as synonymous with key codes. As a result, independently of assignment of percussion instruments to specific key ranges, the electronic keyboard instrument is allowed to reproduce performance data of percussion instruments recorded on the sequencer without the need for conversion of the performance data.

It is another feature of the present invention to provide an electronic keyboard instrument further comprising a plurality of lamps for indicating the plurality of keys, the lamps being provided in association with the keys; and a specific key range indicating portion for illuminating the lamps to indicate assignment of the specific key range by the percussion instrument assigning portion. As a result, the electronic keyboard instrument facilitates player's recognition of the specific key range.

BRIEF DESCRIPTION OF THE DRAWINGS

FIG. 3 is a displayed example of a drum tone color menu of the embodiment;

FIG. 4 is a diagram conceptually showing setting tables applied to the embodiment;

DESCRIPTION OF THE PREFERRED EMBODIMENT

Figure 1:
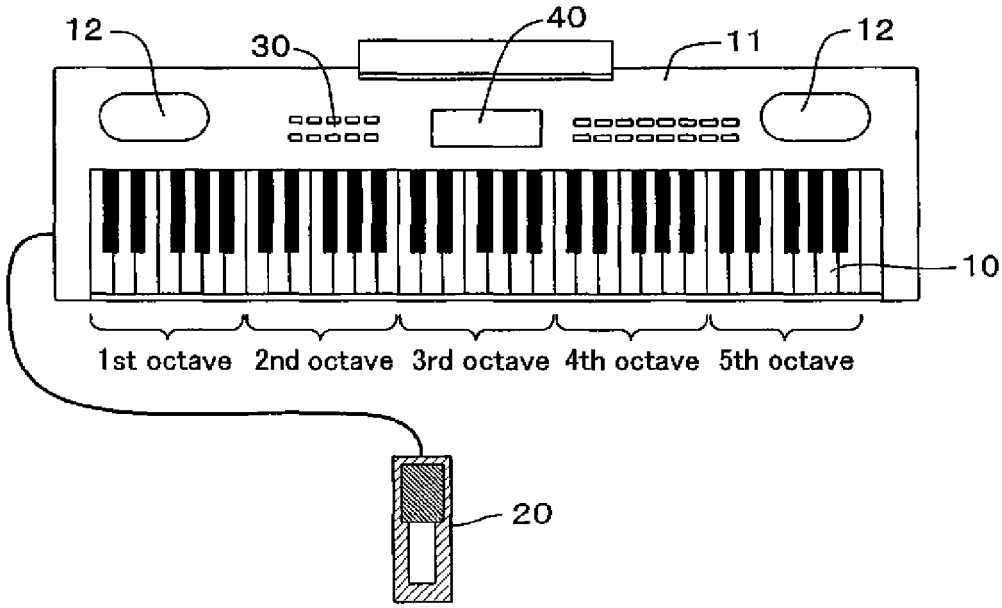
FIG. 1 is an external top view of an electronic keyboard instrument according to an embodiment of the present invention.

An embodiment of the present invention will now be described with reference to the drawings. FIG. 1 is an external top view of an electronic keyboard instrument according to the embodiment of the present invention. A keyboard 10 of the electronic keyboard instrument of this embodiment covers a key range composed of five octaves. In this embodiment, the keyboard contains from the first octave to the fifth octave from the bass side, each octave ranging from "C" to "B". In the following descriptions, since white keys and black keys of the keyboard 10 can be easily distinguished on the drawings, keys will be indicated by octave and known pitch name without code.

To the electronic keyboard instrument, a pedal unit 20 including a pedal which a user holds down with his foot is connected. On a panel 11 of the electronic keyboard instrument, panel operators 30 for specifying various settings such as selection of a tone color for manual performance on the keyboard 10, selection of a drum tone color menu for percussion performance, and selection of sequence recording mode are provided. On the center of the panel 11, a display unit 40 such as a liquid crystal panel is provided. The display unit 40 displays information on various settings such as a drum tone color menu for percussion instruments, assisting the user in making settings through the use of the panel operators 30. On the both sides of the panel 11, tone emitting portions 12 for emitting tones from integrated speakers are provided.

Figure 2:
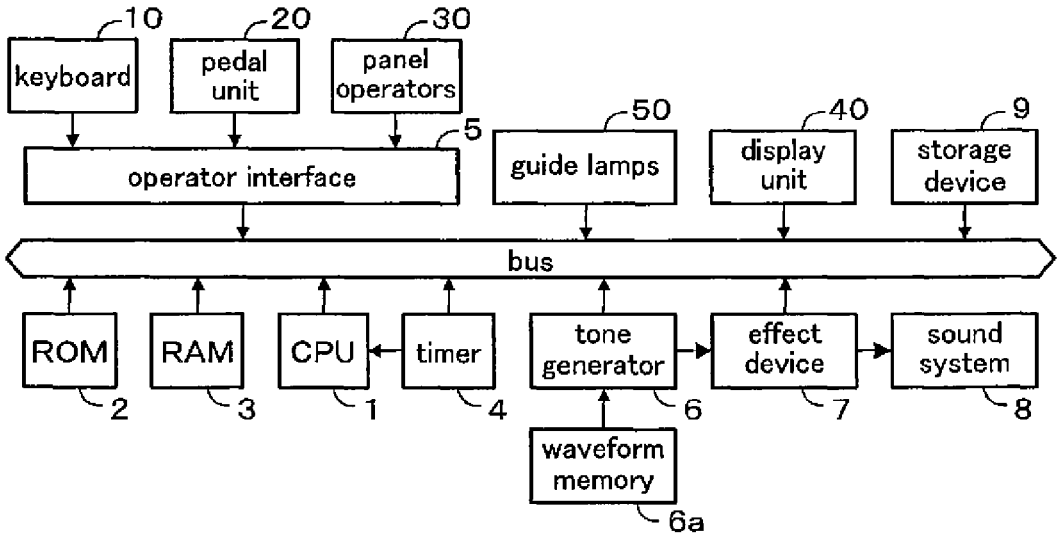
FIG. 2 is a block diagram showing a hardware configuration of the electronic keyboard instrument of the embodiment.

FIG. 2 is a block diagram showing the hardware configuration of the electronic keyboard instrument of the embodiment. A CPU 1 controls operations of the entire instrument by use of a working area provided in the RAM 3 on the basis of control programs stored in a ROM 2. A timer 4 generates clock signals defining performance timings of automatic performance processing and timings for emitting clicks for practice of percussion instruments on the electronic keyboard instrument.

The keyboard 10, the pedal unit 20 and the panel operators 30 are connected to an operator interface 5. The CPU 1 detects key events of the keyboard 10 through the operator interface 5, and controls generation of musical tone signals (ordinary musical tone signals generated by user's operation of the keyboard) having pitches corresponding to keys operated by the user on the keyboard and having a tone color such as piano or stringed instrument. The CPU 1 also controls generation of musical tone signals having tone colors of percussion instruments and being generated by the user through the operation of the keyboard. In addition, the CPU 1 detects operational events of the pedal unit 20 through the operator interface 5, and controls generation manners of musical tone signals corresponding to a percussion instrument. In other words, the CPU 1 controls tone color of the musical tone signals, effect to be added to the musical tone signals, and the like. Furthermore, the CPU 1 detects operational events of the panel operators 30, and carries out processing corresponding to operated switches. Moreover, the CPU 1 controls illumination of a multiplicity of guide lamps 50 each composed of an LED and the like, the guide lamps 50 being provided in association with respective keys of the keyboard 10 for fingering guide. The CPU 1 also controls display on the display unit 40. The guide lamps 50 are provided on the back side of the respective keys, so that the illuminating of the guide lamp 50 results in emission of light on a corresponding key.

A tone generator 6 is provided with a waveform memory 6*a*. Stored in the waveform memory 6*a* is waveform data on various kinds of tone colors such as waveform data on tone colors of various keyboard instruments such as piano, waveform data on tone colors of various wind instruments, waveform data on tone colors of various stringed instruments, waveform data on tone colors of various percussion instruments such as drum set.

The CPU 1 generates musical tone parameters required by the tone generator 6 and supplies the generated parameters to the tone generator 6. The musical tone parameters include a tone color parameter for specifying a tone color (waveform data) of a musical tone, velocity data for specifying loudness, note-on data for indicating start of emission of a tone, and note-off data for indicating termination of emission of a tone. The CPU 1 also supplies effect parameters for controlling effects to be added to musical tones to an effect device 7.

On the basis of the note-on data provided by the CPU 1, the tone generator 6 successively reads out waveform data on tone color specified by the tone color parameters from the waveform memory 6*a*, controls loudness and the like, and then outputs digital musical tone signals to the effect device 7. In accordance with the effect parameters, the effect device 7 adds various effects to the digital musical tone signals through a filter and the like, converts the digital musical tone signals into analog musical tone signals, and then outputs the analog signals to a sound system 8 composed of amplifiers and speakers. As a result, user's operation of the keyboard 10 causes generation of ordinary musical tones having key tone pitches of piano, stringed instrument or the like, or generation of musical tones corresponding to percussion instruments.

A storage device 9 is a hard disk or the like. If the electronic keyboard instrument enters sequence data recording mode by user's operation of the panel operators 30, for instance, musical tone parameters output from the CPU 1 to the tone generator 6 are recorded as sequence data composed of MIDI signals. In addition, waveform data on various tone colors may be supplied from the storage device 9.

FIG. 3 is a displayed example of the drum tone color menu displayed on the display unit 40 in a case where the electronic keyboard instrument enters drum mode. In the drum mode, the electronic keyboard instrument offers a plurality of combinations of tone colors assigned to the keyboard 10. In the shown example, eight combinations from "tone color set 1" to "tone color set 8" are displayed. In this display, "cowbell", "cymbal", "gong", "snare", "conga", "triangle", "hi-hat", "tom", "floor tom" and "bass drum" are names of tone colors of percussion instruments of a drum set and the like. In addition, "open hi-hat" and "closed hi-hat" are names of tone colors which are produced by playing techniques of open hi-hat and closed hi-hat of hi-hat, respectively. Furthermore, "snare roll" and "snare rim shot" are names of tone colors which are produced by playing techniques of snare roll and snare rim shot of snare, respectively. In addition, "stop" indicates that characteristics of a musical tone signal are changed to control an effect (modulation) such that the musical tone has a tone color obtained by reducing reverberation by touching a cymbal so that the emission of the musical tone is immediately terminated, or a tone color obtained by reducing reverberation by striking a cymbal while touching the cymbal with a hand so that the emission of the musical tone is immediately terminated. The above-described control of an effect indicates that characteristics (frequency response and effect to be added) of a musical tone signal corresponding to a normal cymbal tone are changed.

User's operation of the panel operators 30 to select his desired tone color set from the drum tone color menu and to confirm his selection results in a selection of a setting table which will be described later. As a result, tone colors of percussion instruments or a modulation function (modification function) are assigned to specific key ranges (or secondary key ranges) of the keyboard 10. A Key to which the modulation function is assigned will be hereafter referred to as modulation key.

Indicated by the "specific key range" is a key range composed of a plurality of keys to which a percussion instrument of one type (kind of musical instrument) is assigned. Indicated by the "secondary key ranges" is key ranges each composed of a plurality of keys which are included in the "specific key range". Respective tone colors of the "secondary key ranges" are tone colors of the percussion instrument of the specific key range, but are obtained by different playing techniques of the percussion instrument. The relationship between the specific key ranges, the secondary key ranges, and modulation keys and positions of the respective keys of the keyboard will be described later with concrete examples corresponding to the tone color sets shown in FIG. 3.

FIG. 4 is a diagram conceptually showing the setting tables of the embodiment. The setting tables are composed of a plurality of tables corresponding to the tone color sets included in the drum tone color menu. In each table, note numbers (key codes) each corresponding to each key of the keyboard 10 are associated with not only drum tone color numbers each indicative of a tone color of a percussion instrument (percussion instrument of a drum set) and a tone color obtained by a playing technique of the percussion instrument but also control codes and invalid code (–). The shown example illustrates tone colors of "n" kinds from drum tone color number (1) to drum tone color number (n). When a note number of a depressed key of the keyboard 10 is input, it is determined whether the key is instructed to generate a percussion tone (whether the key is a tone-generation instructed key). If so, a corresponding drum tone color number is output. In a case where it is determined that the key is a modulation key, a corresponding control code is output. If the key is neither tone-generation instructed key nor modulation key, the invalid code (–) is output. In addition, data indicative of whether the note number is a key which is instructed to generate a tone or a key which is not instructed to generate a tone is also output.

In this embodiment, as described above, the processing of the CPU 1 and the panel operators 30 for selecting and confirming a tone color set (and a setting table) from among the drum tone color menu correspond to a "percussion instrument assigning portion" for assigning a percussion instrument to a plurality of keys included in a specific key range.

Figure 5:
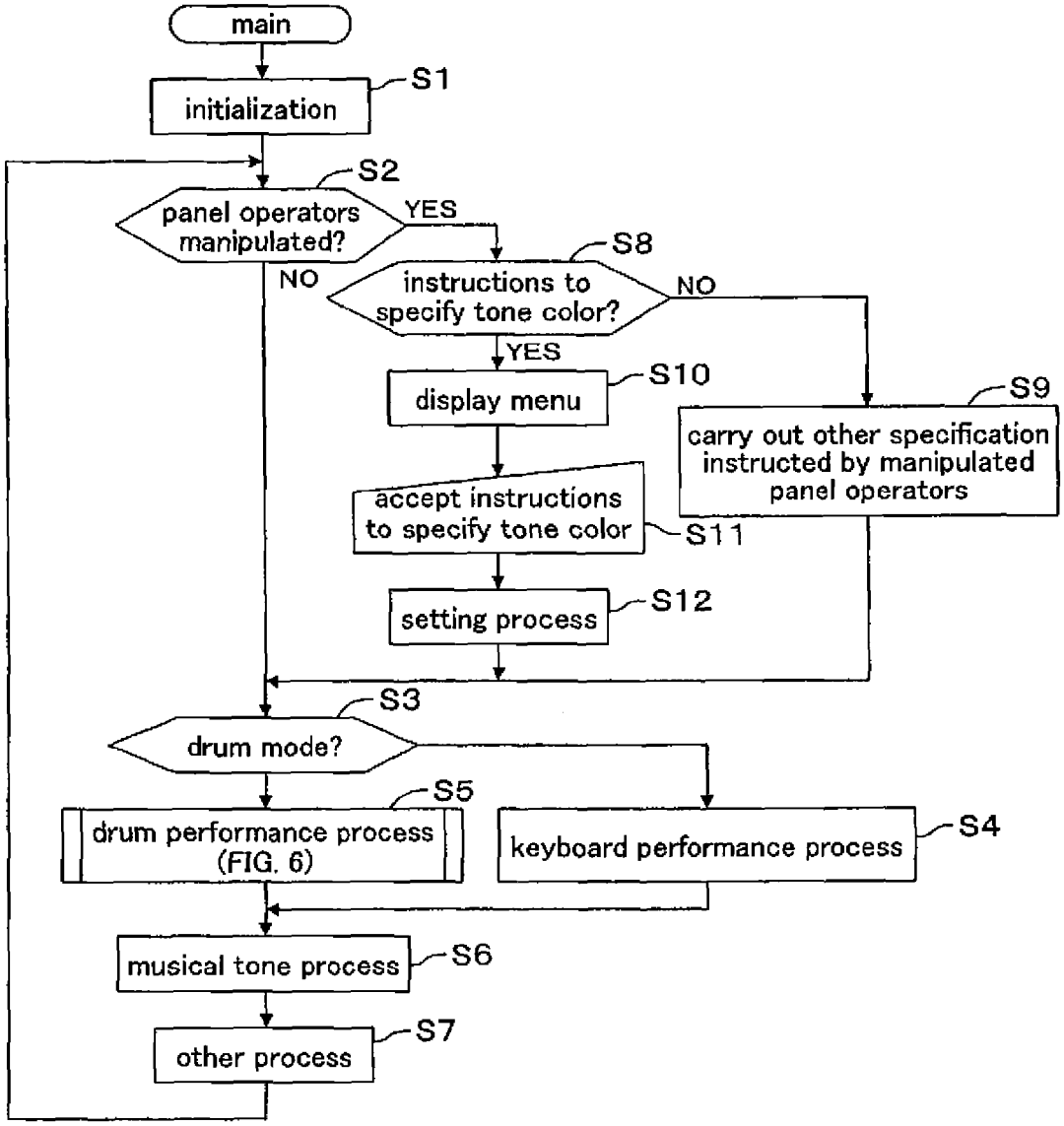
FIG. 5 is a flowchart of an essential part of a main process executed in the embodiment.
Figure 6:
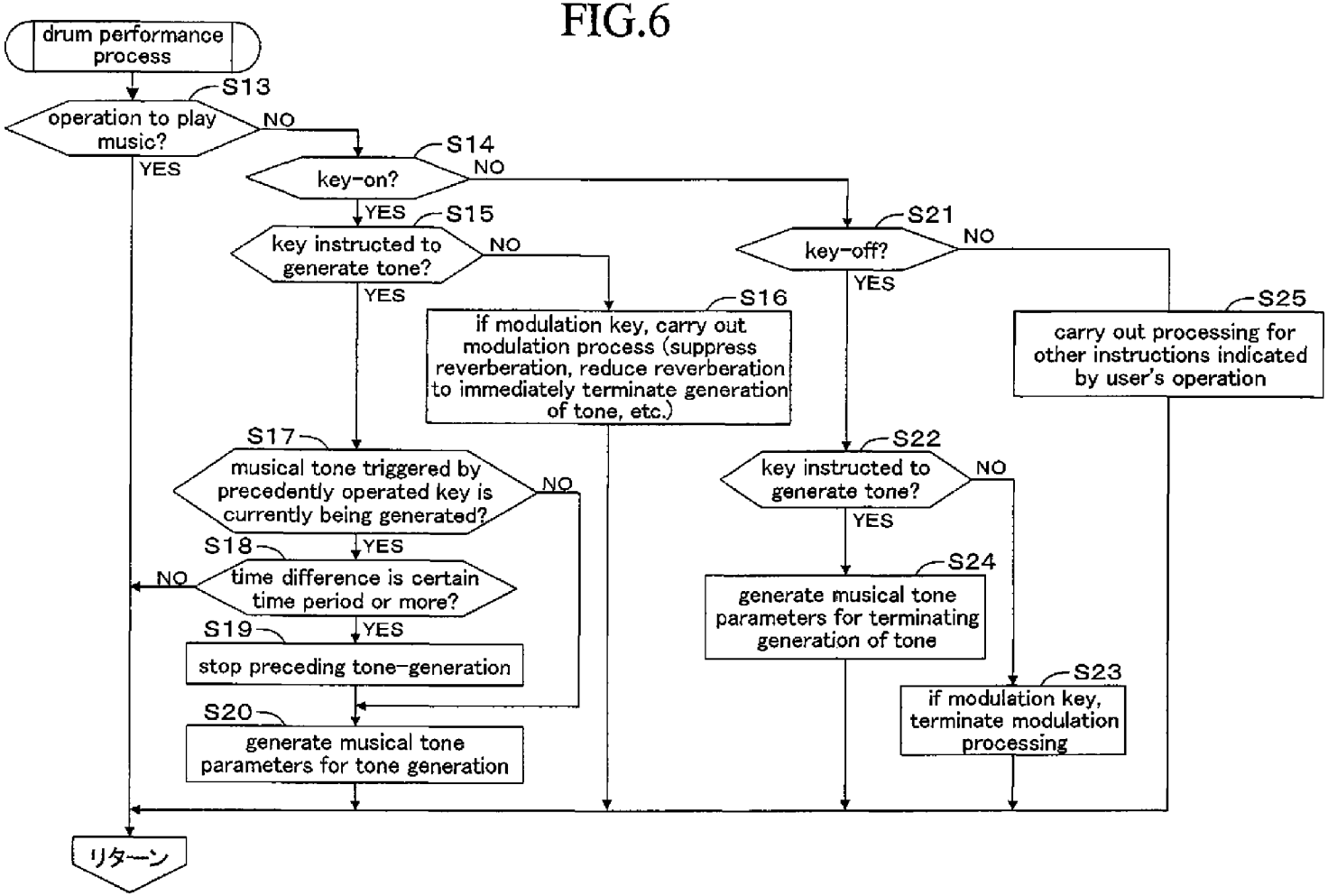
FIG. 6 is a flowchart of a performance process executed in the embodiment.

Next, general operations of the embodiment will be described with reference to flowcharts. FIG. 5 is a flowchart of an essential part of a main process. FIG. 6 is a flowchart of a performance process. The "main process" shown in FIG. 5 is started when the power of the electronic keyboard instrument is turned on. In step S1, the CPU 1 carries out initialization such as resetting of flags and registers. In step S2, the CPU 1 determines whether or not the user has manipulated any of the panel operators 30. If there is no manipulation of the panel operators 30, the CPU 1 proceeds to step S3 to determine whether the electronic keyboard instrument is in drum mode. If the electronic keyboard instrument is not in drum mode, the CPU 1 proceeds to step S4 to carry out an ordinary keyboard performance process, and then proceeds to step S6. This keyboard performance process is a process for generating musical tone signals having pitches corresponding to depressed keys. If the CPU 1 determines in step S3 that the electronic keyboard instrument is in drum mode, the CPU 1 proceeds to step S5 to carry out the drum performance process (FIG. 6). The CPU 1 then proceeds to step S6 and outputs musical tone parameters to the tone generator 6 to carry out a musical tone process such as generation of a tone or termination of generation of a tone. The CPU 1 then carries out other process in step S7. These processes are repeated as long as the electronic keyboard instrument has power applied to it.

If the CPU 1 determines in step S2 that any of the panel operators 30 has been manipulated, the CPU 1 proceeds to step S8 to determine whether or not the manipulation has been done to specify a tone color. If not, the CPU 1 proceeds to step S9 to carry out the other specification instructed through the manipulation of the panel operators 30, and then proceeds to step S3. If the manipulation has been done to specify a tone color, the CPU 1 proceeds to step S10 to display the drum tone color menu (FIG. 3) or a different tone color menu, and then proceeds to step S11 to accept instructions to specify a tone color (e.g., to accept a manipulation for selecting a tone color set). The CPU 1 then proceeds to step S12 to carry out a process for making settings such as determining of a setting table, and then proceeds to step S3.

In the drum performance process shown in FIG. 6, the CPU 1 determines in step S13 whether there are user's operations for playing music, that is, whether the user has operated the keyboard 10 or the pedal unit 20 to play music. If not, the CPU 1 returns to the previous routine without any processing. If the CPU 1 determines that the user has operated the keyboard 10 or the pedal unit 20, the CPU 1 carries out processing for a key-on event in steps S14 to S20, while the CPU 1 carries out processing for a key-off event in steps S21 to S24. In step S25, in addition, the CPU 1 carries out processing for other instructions indicated by the user's operation. In step S25, more specifically, the CPU 1 carries out processing for user's pedal operation of the pedal unit 20 as described later.

In the case of a key-on event, the CPU 1 determines in step S15 whether the user's operation is a key-on event of a tone-generation instructed key (a key to which a tone color of a percussion instrument is assigned). If so, the CPU 1 proceeds to step S17. If not, the CPU 1 proceeds to step S16. If the user's operation is a key-on event of a modulation key, the CPU 1 carries out modulation processing in accordance with a control code in step S16. In step S16, more specifically, the CPU 1 generates an effect parameter for controlling a filter and/or an effect circuit of the effect device 7, for instance. After the modulation processing of step S16, the CPU 1 returns to the previous routine. If the user's operation is a key-on event of any other key (a key falling outside the specific key ranges), the CPU 1 returns to the previous routine without carrying out any processing in step S16. If the user's operation is a key-on event of a tone-generation instructed key, the CPU 1 determines in step S17 whether a musical tone to be triggered by the tone-generation instructed key (a musical tone triggered by another tone-generation instructed key for the same tone color as that of the tone-generation instructed key) is currently being generated. If not, the CPU 1 proceeds to step S20. If so, the CPU 1 proceeds to step S18 to determine whether a certain time period or more has elapsed since the preceding key-on event of the precedently operated tone-generation instructed key which triggered the current tone-generation. That is, it is determined in step S18 whether a time difference between now and the preceding key-on event of the precedently operated tone-generation instructed key which triggered the current tone-generation is a certain time period or more. If not, the CPU 1 returns to the previous routine without carrying out any processing. If so, the CPU 1 proceeds to step S19 to carry out processing for stopping the preceding tone-generation (generating a note-off and the like), and then moves to step S20. In step S20, the CPU 1 generates musical tone parameters (including a drum tone color number) for tone generation corresponding to the key that the user has operated (subsequent tone-generation instructed key), and then returns to the previous routine.

In the case of a key-off event, the CPU 1 determines in step S22 whether the user's operation is a key-off event of a tone-generation instructed key. If so, the CPU 1 proceeds to step S24. If not, the CPU 1 proceeds to step S23. If the user's operation is a key-off event of a modulation key, the CPU 1 terminates, in step S23, modulation processing which is done in accordance with a control code, and then returns to the previous routine. If the user's operation is a key-off event of any other key (a key falling outside the specific key ranges), the CPU 1 returns to the previous routine without carrying out any processing. If the user's operation is a key-off event of a tone-generation instructed key, the CPU 1 proceeds to step S24 to generate musical tone parameters for terminating generation of a tone corresponding to the operated key, and then returns to the previous routine.

In the above-described drum performance process, in a case where tone-generation instructed keys for the same tone color (falling within the same specific key range or the same secondary key range) are consecutively depressed within a certain time period (the time difference is less than the certain time period), tone-generation of the most preceding key-on event is enabled, with tone-generation of the following key-on events being disabled. Even though a key-depression of a specific key range is followed by a key-depression of a neighboring key falling within the same key range with a small time interval, as a result, consecutive tone-generation caused by consecutive key-on events in a short time period (i.e, substantial concurrent generation of a plurality of tones) is prevented. Resultantly, muddiness of tones and reduction in loudness caused by antiphase of the waveform of tones can be prevented. The criteria for the determination on time difference are arbitrarily provided. In a case where keys included in different key ranges are consecutively depressed with small time intervals, musical tones having different tone colors are generated in spite of substantial concurrent generation of tones, for there is no time restriction on substantial concurrent generation of tones triggered by keys included in different key ranges.

Figure 7:
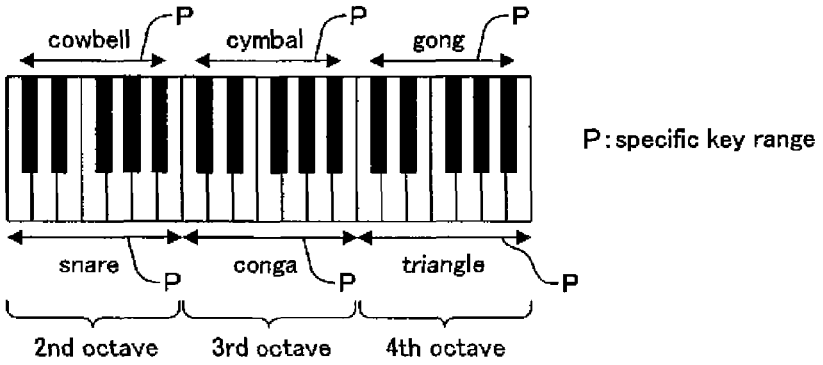
FIG. 7 illustrates an example assignment of tone colors included in tone color set 1 according to the embodiment.

FIGS. 7 to 12 are diagrams showing example assignments of tone colors of percussion instruments to specific key ranges of the keyboard 10, the assignments being associated with the tone color sets shown in FIG. 3. Numbers provided for respective octaves will be similarly provided even if the numbers are shifted to the treble side or the bass side. FIG. 7 is an example of tone color set 1 shown in FIG. 3. In the example of FIG. 7, specific key ranges "P" (i.e., percussion instruments) are provided for the second to fourth octaves, respectively. A set of black keys included in each octave is defined as a specific key range "P", with "cowbell", "cymbal" and "gong" being assigned to the respective specific key ranges "P". A set of white keys included in each octave is defined as a specific key range "P", with "snare", "conga", and "triangle" being assigned to the respective specific key ranges "P". Depression of any key included in a specific key range "P" results in generation of a musical tone having a tone color of a percussion instrument assigned to the specific key range "P". In a case where the user desires to produce drum tones, this embodiment enables the user to generate musical tones having tone colors of percussion instruments by stretching his fingers to depress keys or depressing keys with his palm or fingers instead of sticks. In this embodiment, as described above, various tone colors are assigned to keys on an octave basis, facilitating user's visual recognition of boundaries between the tone colors of percussion instruments. As a result, this embodiment reduces mistakes of making wrong tones even for beginners. Since this embodiment employs the keyboard without any modification, in addition, the embodiment may be applied not only to performance of drum set on the keyboard but also to performance of any musical instrument such as keyboard instrument, wind instrument and stringed instrument on the keyboard.

Figure 8:
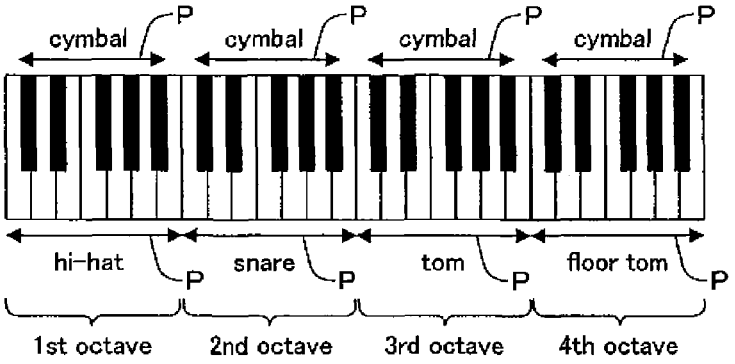
FIG. 8 illustrates an example assignment of tone colors included in tone color set 2 according to the embodiment.

FIG. 8 is an example of tone color set 2 shown in FIG. 3. In the example of FIG. 8, each of percussion instruments included in a drum set is assigned to each octave, so that the percussion instruments are provided for four octaves. More specifically, a set of black keys of each of the first to fourth octaves is defined as specific key range "P", and "cymbal" is assigned to the respective specific key ranges "P". Since a drum set includes different kinds of cymbals of different sizes, different cymbals are assigned to the respective specific key ranges "P" of the black keys respectively. A set of white keys of each of the first to fourth octaves is defined as specific key range "P", and "hi-hat", "snare", "tom", and "floor tom" are assigned to the specific key ranges "P".

Figure 9:
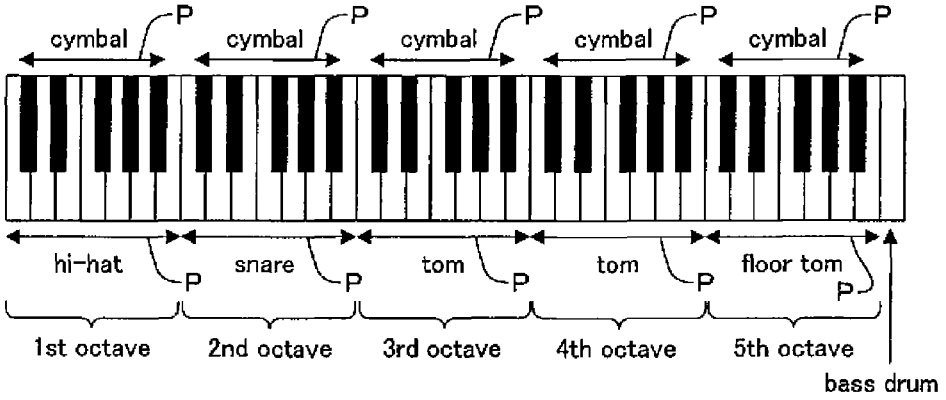
FIG. 9 illustrates an example assignment of tone colors included in tone color set 3 according to the embodiment.

FIG. 9 is an example of tone color set 3 shown in FIG. 3. In the example of FIG. 9 as well, each of percussion instruments included in a drum set is assigned to each octave. More specifically, a set of black keys of each of the first to fifth octaves is defined as specific key range "P" and "cymbal" is assigned to the respective specific key ranges "P". Similarly to FIG. 8, in this example as well, different kinds of cymbals are assigned to the respective specific key ranges "P" of the black keys. A set of white keys of each of the first to fifth octaves is defined as specific key range "P", and "hi-hat", "snare", "tom", "tom" and "floor tom" are assigned to the respective specific key ranges "P". To a white key having the most treble pitch (C), in addition, a tone color of "bass drum" is assigned.

In the examples shown in FIG. 8 and FIG. 9, furthermore, "snare" and "hi-hat" may be replaced each other in order to correspond with their playing techniques which require the player to cross his arms. In these examples, in addition, the assignment of percussion instruments is associated with the arrangement of a drum set, allowing the player to enjoy, on the electronic keyboard instrument, performance of a drum set arranged similarly to a real drum set, and also allowing the player to manipulate the operators spontaneously without any difficulty as long as he has learned how to play drums. For beginners, this embodiment allows to enjoy, with ease, getting rhythm using their body, providing effective assistance in learning how to play drums.

In the examples shown in FIG. 7 to FIG. 9, a set of black keys included in each octave and a set of white keys included in each octave are defined as specific key range "P", respectively, each specific key range "P" being provided for control of generation of a tone having a tone color of a percussion instrument assigned to the specific key range "P". Each specific key range "P" is basically associated with a percussion instrument of one kind. In the following examples, respective specific key ranges "P" further include secondary key ranges "Q" and modulation keys "R". The secondary key ranges "Q" and the modulation keys "R" of a specific key range "P" are used for control of tone-generation such as playing techniques of a percussion instrument assigned to the specific key range.

Figure 10A:
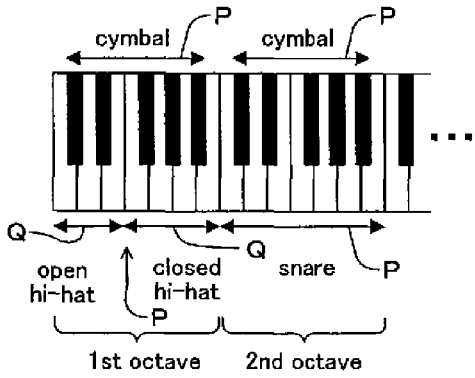
FIGS. 10A to 10C illustrate example assignments of tone colors included in tone color sets 4, 5 and 6 according to the embodiment.
Figure 10B:
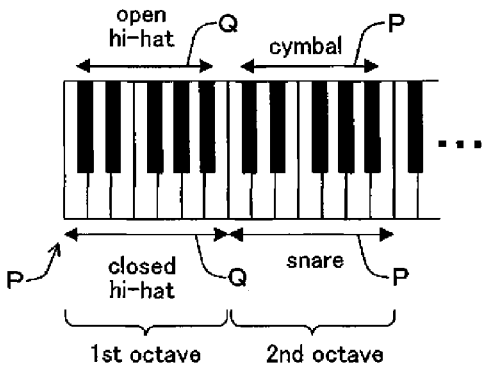
Figure 10C:
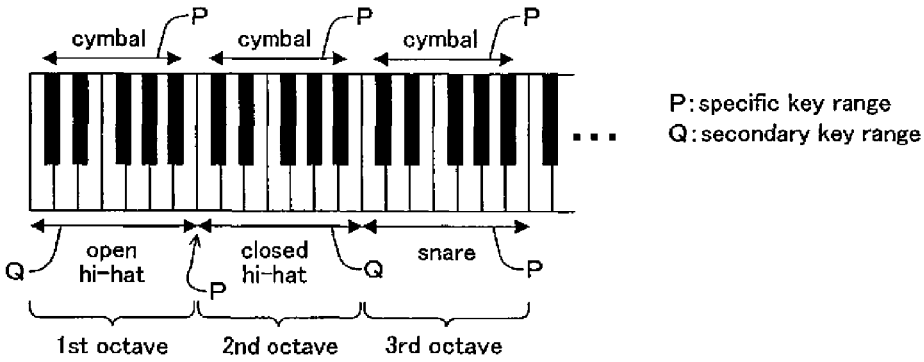

FIG. 10A is an example of tone color set 4 shown in FIG. 3. FIG. 10B is an example of tone color set 5. FIG. 10C is an example of tone color set 6. In the shown examples, the specific key ranges "P" to which hi-hat (a type of percussion instrument) are assigned include secondary key ranges "Q" to which different tone colors of different playing techniques of "open hi-hat" and "closed hi-hat" are respectively assigned. Descriptions other than the secondary key ranges are similar to those of the above-described examples. In FIG. 10A, a set of white keys of the first octave is defined as a specific key range "P" provided for the control of tone-generation with the tone colors of hi-hat. Furthermore, keys C, D and E of the first octave are defined as one secondary key range "Q", while keys F, G, A and B are defined as the other secondary key range "Q". To each of the two secondary key ranges "Q", a tone color generated by a different playing technique is assigned. In FIG. 10B, all the keys of the first octave are defined as a specific key range "P" provided for the control of tone-generation with the tone colors of hi-hat. Furthermore, a set of black keys of the first octave is defined as one secondary key range "Q", while a set of white keys of the first octave is defined as the other secondary key range "Q". To each of the two secondary key ranges "Q", a different tone color is assigned. In FIG. 10C, combined sets of white keys of the first and second octaves are defined as a specific key range "P" provided for the control of tone-generation with the tone colors of hi-hat. Furthermore, the set of white keys of the first octave is defined as one secondary key range "Q", while the set of white keys of the second octave is defined as the other secondary key range "Q". To each of the two secondary key ranges "Q", a different tone color is assigned.

Hi-hat is a kind of musical instrument, but includes the playing techniques of open hi-hat and closed hi-hat to generate different tones (tone colors). In consideration of the different playing techniques provided by the same hi-hat, the two different playing techniques are included in the same specific key range as described above, while the secondary key ranges included in the specific key range allow the player to independently generate musical tones having the different tone colors generated by "open hi-hat" and "closed hi-hat". As a result, the embodiment enables the player to play with the different playing techniques of the musical instrument without discomfort.

Figure 11:
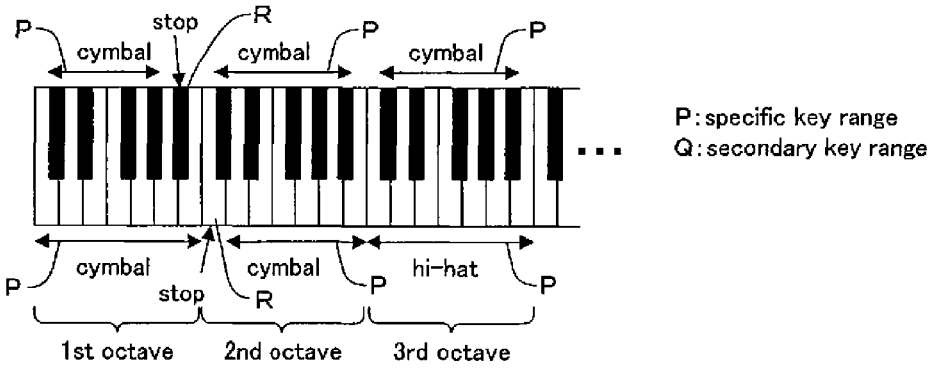
FIG. 11 illustrates an example assignment of tone colors included in tone color set 7 according to the embodiment.

FIG. 11 is an example of tone color set 7 shown in FIG. 3. In this example, the first octave and the second octave are defined as a specific key range "P", respectively, for the control of tone-generation with the tone color of cymbal. Furthermore, a key A# of the first octave and a key C of the second octave are defined as a modulation key "R" (stop), respectively. For instance, a depression of any key of the first octave other than the key A# results in generation of a musical tone of cymbal, and a subsequent depression of the key A# results in suppression of reverberation of the generated cymbal tone to immediately terminate the generation of the tone. If the player depresses a key while depressing the key A#, a cymbal tone is generated with suppressed reverberation, but is immediately terminated. This mechanism is also applied to the operation of the key C of the second octave which generates cymbal tone as well. As described above, this embodiment also enables the playing technique in which the player touches a cymbal with his hand to change (modulate) the tone color.

Figure 12:
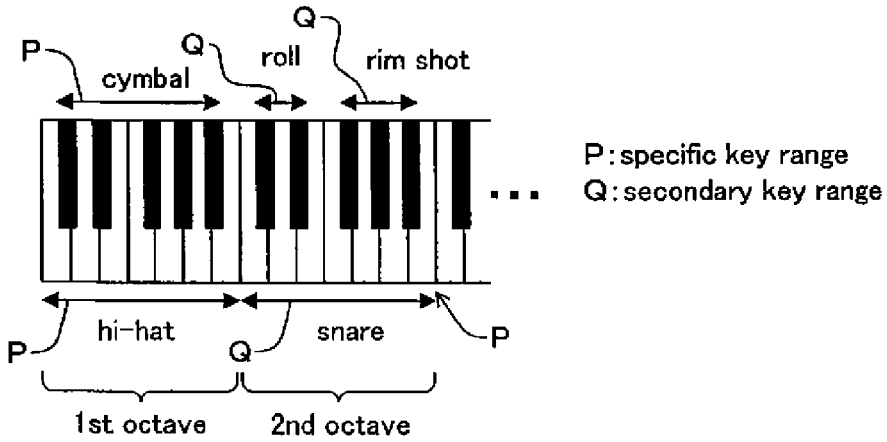
FIG. 12 illustrates an example assignment of tone colors included in tone color set 8 according to the embodiment.

FIG. 12 is an example of tone color set 8 shown in FIG. 3. In this example, tone colors each corresponding to a different playing technique of snare (a type of percussion instrument) are assigned. The example of FIG. 12 except the snare is similar to the above-described examples. More specifically, the second octave is defined as a specific key range "P" provided for the control of tone-generation with the tone colors of snare. Furthermore, a set of white keys of the second octave is defined as the first secondary key range "Q", black keys C# and D# of the second octave are defined as the second secondary key range "Q", and black keys F#, G# and A# are defined as the third secondary key range "Q". To the first secondary key range "Q", a tone color of normal snare is assigned. To the second secondary key range "Q", a tone color produced by snare roll is assigned. To the third secondary key range "Q", a tone color produced by snare rim shot is assigned.

Snare is also a kind of musical instrument, but includes the playing techniques of normal snare, roll and rim shot to generate different tones (tone colors). As in the case of hi-hat, in consideration of the different playing techniques provided by the same snare, the three different playing techniques are included in the same specific key range, while the secondary key ranges included in the specific key range allow the player to independently generate musical tones having the different tone colors generated by "normal snare", "roll" and "rim shot". As a result, the embodiment enables the player to play with the different playing techniques of the musical instrument without discomfort.

In the above-described examples, different tone colors produced by different playing techniques such as open and closed techniques on hi-hat and roll and rim shot techniques on snare are assigned to the key ranges, however, other playing techniques may be assigned. For instance, a plurality of different tone colors corresponding to various positions of a cymbal to strike may be assigned to secondary key ranges. Alternatively, a plurality of different tone colors corresponding to a tone color produced when snare is struck with a stick, a tone color produced when snare is struck with a brush, and a tone color produced when snare is rubbed with a brush may be assigned to secondary key ranges. Furthermore, different tone color sets each including different tone colors produced by striking with different sticks may be provided for respective percussion instruments in order to allow replacement of the tone color sets to be assigned to the specific key ranges.

Figure 13:
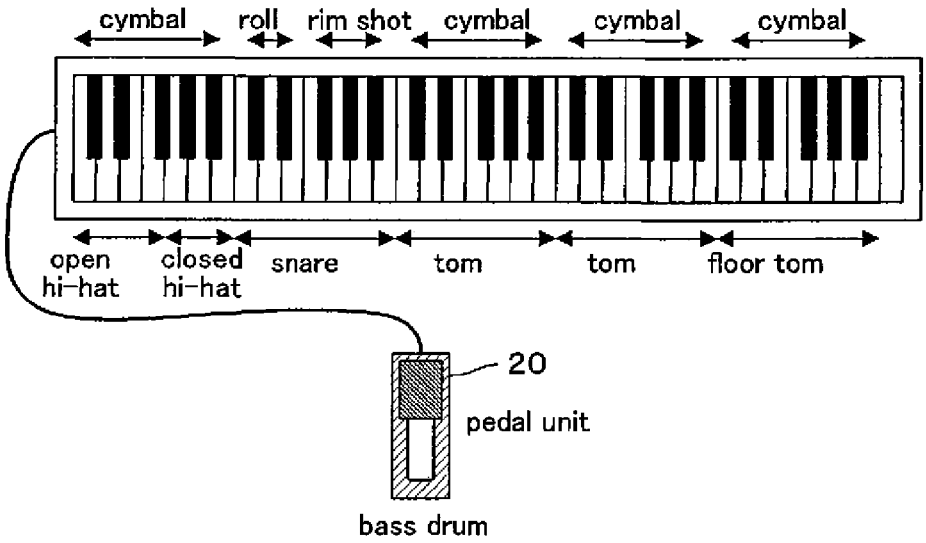
FIG. 13 illustrates an example which uses a pedal unit according to the embodiment.

FIG. 13 is an example which employs the pedal unit 20. In the keyboard 10, similarly to the above-described examples, specific key ranges are set. More specifically, various tone colors of percussion instruments are assigned to the specific ranges as shown in FIG. 13. In addition, user's stepping-on (pedal-on) operation of the pedal unit 20, to which a tone color of bass drum is assigned, triggers generation of a musical tone of a bass drum. Processing corresponding to the pedal-on operation of the pedal unit 20 is carried out in step S25 of FIG. 6, for example. In this case, the CPU 1 generates a drum tone color number of the bass drum in step S25, and then outputs, in step S6, the drum tone color number to the tone generator as a musical tone parameter.

In performance of a drum set, in general, performance on the bass drum with player's foot assumes an important position. However, it is substantially impossible for the player to play the bass drum on the keyboard 10 concurrently with the playing of the drum set on the entire keyboard 10 with his both hands. This problem can be overcome by allowing the player to play the bass drum on the pedal unit 20. It is advantageous for the user that the embodiment does not require any specifically designed device, for the pedal unit is used in performance of the keyboard instrument as well.

Many of less expensive pedal units have an on/off function only, however, such pedal units which generate a tone when the pedal is stepped on substantially present no problem, for the bass drum does not require control of intensity of tones. The loudness of the bass drum may be previously determined. Alternatively, the embodiment may be modified such that the user is allowed to set his desired velocity by operating the panel operators 30, for example, so that musical tones of the bass drum are emitted in certain loudness of the set velocity.

In a case of the pedal unit 20 which employs not only the on/off interface but also a volume interface, since such pedal unit 20 is capable of sensing a position of a pedal stroke in analog fashion, the velocity of the pedal operation can be obtained on the basis of time taken to pass a predetermined section. On the basis of the operational velocity of the pedal unit 20, the velocity of a musical tone to be emitted can be obtained to vary the loudness of the bass drum, resulting in realistic performance which is closer to a real drum set. The above-described method of sensing operational velocity of the pedal may be replaced with other methods. For instance, the pedal unit may have two switches which are turned on by different amounts of user's stepping-on so that the electronic keyboard instrument can measure the time interval between the points in time when the two switches are turned on by the user's pedal operation in order to obtain operational velocity of the pedal operation in accordance with the measured result. Alternatively, the pedal unit 20 may integrate a velocity sensor (e.g., an electromagnetic sensor which employs a magnet and a coil) for sensing velocity at which the pedal is stepped on so that the velocity sensor senses operational velocity of the pedal.

In addition, the embodiment may be modified such that the user is allowed to change the position of the above-described section through the operation of the panel operators 30 to change the positions where the pedal is turned on so that the user can customize the position where the pedal starts to emit a tone. This modification increases ease of operation of the electronic keyboard instrument. The above-described processing for making settings by use of the panel operators 30 is carried out in step S9 of FIG. 5.

Figure 14A:
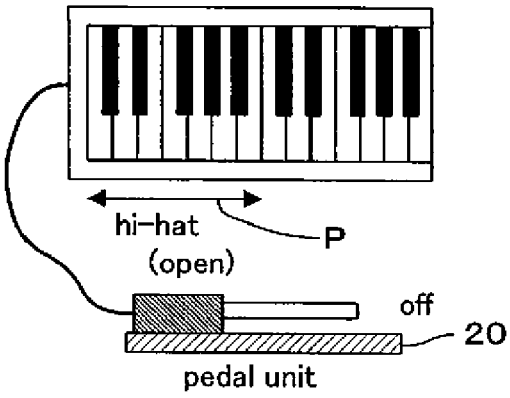
FIGS. 14A and 14B illustrate other examples which use the pedal unit according to the embodiment.
Figure 14B:
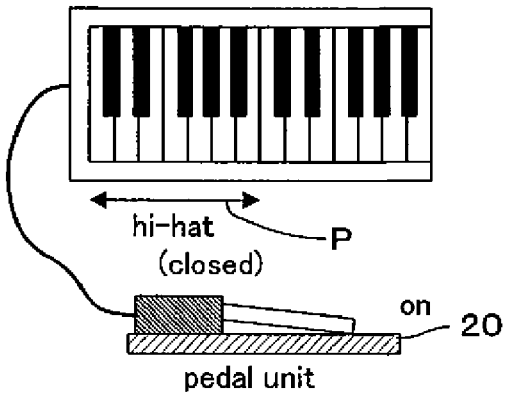

FIG. 14A and FIG. 14B illustrate the other example of the embodiment which employs the pedal unit 20, the example having at least a tone color of hi-hat assigned to the specific key range provided for the keyboard 10. In this example, the tone color of hi-hat is assigned to the specific key range "P" of the most bass side. In this example, a depression of any key included in the specific key range "P" generates a musical tone of hi-hat. More specifically, if any key of the specific key range "P" is depressed while the pedal of the pedal unit 20 is not operated (pedal-off state), an open hi-hat sound is generated. If any key of the specific key range "P" is depressed while the pedal of the pedal unit 20 is operated (pedal-on state), a closed hi-hat sound is generated.

In the examples of FIG. 10 and FIG. 13, the player is required to depress keys of the different secondary key ranges "Q" included in the same specific key range "P" in order to generate an open hi-hat sound and a closed hi-hat sound. In the case of FIG. 10C, particularly, the player feels strange because the player is required to behave in a manner which is different from the behavior required by a real drum set in order to generate an open hi-hat sound and a closed hi-hat sound. However, the example shown in FIG. 14A and FIG. 14B allows the player to generate both an open hi-hat sound and a closed hi-hat sound by depression of the same key of the specific key range "P", enabling the player to enjoy performance of drums on the electronic keyboard instrument in the same manner as a real drum set, and also resulting in improved operability of the electronic keyboard instrument.

The above-described embodiment may be modified such that if generation of an open hi-hat sound caused by a depression of a key with the pedal of the pedal unit 20 being off is turned into a closed hi-hat sound by switching the pedal unit 20 to pedal-on state. Furthermore, a contact tone (plash) made by the both cymbals of the hi-hat touching each other may be generated at timings when the pedal unit 20 is switched to the pedal-on state. These modifications enable more realistic drum performance on the electronic keyboard instrument.

The processing for switching between open hi-hat and closed hi-hat is done by switching drum tone color numbers to be generated in step S25 of FIG. 6. Furthermore, the processing for generating the contact tone to be generated on switching to the pedal-on state is done by switching effect parameters to be output to the effect device 7 or generating a drum tone color number which specifies the contact tone concurrently with the switching of the effect parameters.

In the above-described embodiment, in a case where the electronic keyboard instrument is set at sequence data recording mode at the time of drum performance, sequence data (performance data) is recorded onto a specified storage medium of the storage device 9. More specifically, if a key is depressed, the CPU 1 obtains a drum tone color number of a percussion instrument assigned to a specific key range or a secondary key range which includes the depressed key or a control code corresponding to the depressed key. On the depression of the key, the obtained drum tone color number or the control code is recorded along with timing data generated on the basis of a clock signal of the timer 4 onto the storage medium of the storage device 9 as MIDI signals. This processing is done in step S7 of FIG. 5. In this case, the CPU 1 and the storage device 9 also serve as a sequencer. As a result, independently of assignment of percussion instruments to specific key ranges, the electronic keyboard instrument is allowed to reproduce performance data of percussion instruments recorded on the sequencer without the need for conversion of the performance data.

As described above, the present invention achieves realistic drum performance on electronic keyboard instruments many of which are less expensive, enabling beginners to experience a full drum set on a handy keyboard. In addition to normal keyboard performance, as a result, the present invention also broadens music practice.

Since the electronic keyboard instrument of the embodiment has the guide lamps 50 composed of a multiplicity of LEDs, the electronic keyboard instrument may illuminate, in a case where a specific key range is provided, the guide lamps 50 of the keys located on the both sides of the specific key range. Alternatively, in a case where specific key ranges are provided, the electronic keyboard instrument may illuminate the guide lamps 50 of the entire keys of the respective specific key ranges so that neighboring key ranges illuminate in different colors. Such illumination further helps player's perception of specific key ranges. Furthermore, the guide lamps 50 provided on the underside of the keys may be provided on anywhere as long as the guide lamps 50 can indicate their corresponding keys. For instance, the guide lamps 50 may be provided in the front or rear of the keys.

What is claimed is:

1. An electronic keyboard instrument comprising:

a keyboard having a plurality of keys;

a percussion instrument assigning portion for assigning a type of percussion instrument to a plurality of keys included in a specific key range of the keyboard; and a musical tone generation controlling portion for controlling, in a case where any of the keys included in the specific key range is depressed, generation of a musical tone signal having a tone color of the percussion instrument assigned to the specific key range which includes the depressed key, wherein in a case where a plurality of keys included in the specific key range of the keyboard are depressed concurrently or consecutively in a certain short period of time, the musical tone generation controlling portion responds only to the first key-depression to control generation of one musical tone signal.

2. An electronic keyboard instrument according to claim 1, wherein the specific key range is variable.

3. An electronic keyboard instrument according to claim 1, wherein the specific key range is provided on an octave basis.

4. An electronic keyboard instrument according to claim 3, wherein the specific key range consists of a plurality of neighboring black keys included in an octave or a plurality of neighboring white keys included in an octave.

5. An electronic keyboard instrument according to claim 1, further comprising:

a pedal operated with a foot, wherein the musical tone generation controlling portion controls generation of a musical tone signal having a tone color of bass drum in response to operation of the pedal.

6. An electronic keyboard instrument according to claim 5, further comprising:

a velocity sensing portion for sensing operational velocity of the pedal, wherein the musical tone generation controlling portion controls loudness of a musical tone signal to be generated in accordance with an operational velocity of the pedal sensed by the velocity sensing portion.

7. An electronic keyboard instrument according to claim 1, further comprising:

a sequencer for recording performance of percussion tones by depression of the keys included in the specific key range, wherein the sequencer records not performance data indicative of pitch of the depressed keys but performance data indicative of the percussion instrument assigned to the specific key range.

8. An electronic keyboard instrument according to claim 1, further comprising:

a plurality of lamps for indicating the plurality of keys, the lamps being provided in association with the keys; and a specific key range indicating portion for illuminating the lamps to indicate assignment of the specific key range by the percussion instrument assigning portion.

9. An electronic keyboard instrument comprising:

a keyboard having a plurality of keys;

a percussion instrument assigning portion for assigning a type of percussion instrument to a plurality of keys included in a specific key range of the keyboard; and a musical tone generation controlling portion for controlling, in a case where any of the keys included in the specific key range is depressed, generation of a musical tone signal having a tone color of the percussion instrument assigned to the specific key range which includes the depressed key, wherein the percussion instrument assigning portion assigns a plurality of percussion instruments included in a drum set to a plurality of specific key ranges arranged in a direction of the keys of the keyboard such that the assignment of the percussion instruments to the specific key ranges corresponds with an arrangement of the drum set, and wherein the musical tone generation controlling portion controls generation of a musical tone signal having a tone color of a percussion instrument assigned to a specific key range including the depressed key.

10. An electronic keyboard instrument comprising:

a keyboard having a plurality of keys;

a percussion instrument assigning portion for assigning a type of percussion instrument to a plurality of keys included in a specific key range of the keyboard; and a musical tone generation controlling portion for controlling, in a case where any of the keys included in the specific key range is depressed, generation of a musical tone signal having a tone color of the percussion instrument assigned to the specific key range which includes the depressed key, wherein the percussion instrument assigning portion divides the specific key range into a plurality of secondary key ranges each composed of a plurality of keys, and assigns a plurality of tone colors produced by different playing techniques of the type of percussion instrument assigned to the specific key range to the secondary key ranges, respectively, and wherein in a case where any key of the secondary key ranges is depressed, the musical tone generation controlling portion controls generation of a musical tone signal having a tone color assigned to the secondary key range which includes the depressed key.

11. An electronic keyboard instrument according to claim 10, wherein tone colors of hi-hat are assigned to the specific key range, and a tone color of open hi-hat and a tone color of closed hi-hat are assigned to the secondary key ranges respectively.

12. An electronic keyboard instrument according to claim 10, wherein tone colors of snare are assigned to the specific key range, and at least two of a tone color of normal snare and a tone color of roll or a tone color of rim shot are assigned to the secondary key ranges respectively.

13. An electronic keyboard instrument according to claim 10, wherein tone colors of at least one of snare, hi-hat, or cymbal are assigned to the specific key range, and a tone color produced when played with sticks and a tone color produced when played with brush are assigned to the secondary key ranges respectively.

14. An electronic keyboard instrument according to claim 10, wherein the plurality of keys included in each of the secondary key ranges are composed of only white keys or only black keys.

15. An electronic keyboard instrument comprising:

a keyboard having a plurality of keys;

a percussion instrument assigning portion for assigning a type of percussion instrument to a plurality of keys included in a specific key range of the keyboard; and a musical tone generation controlling portion for controlling, in a case where any of the keys included in the specific key range is depressed, generation of a musical tone signal having a tone color of the percussion instrument assigned to the specific key range which includes the depressed key, wherein the percussion instrument assigning portion allows the specific key range to further include a key to which a modification function for modifying a generation manner of a musical tone signal corresponding to the percussion instrument assigned to the specific key range is assigned, and wherein the musical tone generation controlling portion further modifies, in a case where the key to which the modification function is assigned is depressed, the generation manner of a musical tone signal generated by a depression of any other key of the specific key range.

16. An electronic keyboard instrument according to claim 15, wherein in a case where the key to which the modification function is assigned is depressed during generation of a musical tone signal by a depression of any other key of the specific key range, the musical tone generation controlling portion changes a tone color of the musical tone signal generated by the depression of the other key and then terminates generation of the musical tone signal.

17. An electronic keyboard instrument according to claim 15, wherein in a case where the key to which the modification function is assigned is depressed prior to generation of a musical tone signal by a depression of any other key of the specific key range, the musical tone generation controlling portion generates a musical tone signal having a tone color different from that of a musical tone signal to be generated without depression of the key to which the modification function is assigned, and also terminates generation of the musical tone signal earlier than termination of generation of a musical tone signal to be generated without depression of the key to which the modification function is assigned.

18. An electronic keyboard instrument comprising:

a keyboard having a plurality of keys;

a percussion instrument assigning portion for assigning a type of percussion instrument to a plurality of keys included in a specific key range of the keyboard;

a musical tone generation controlling portion for controlling, in a case where any of the keys included in the specific key range is depressed, generation of a musical tone signal having a tone color of the percussion instrument assigned to the specific key range which includes the depressed key; and a pedal operated with a foot, wherein the musical tone generation controlling portion changes a tone color of a musical tone signal generated by a depression of a key included in the specific key range in accordance with operation of the pedal.

19. An electronic keyboard instrument according to claim 18, wherein in a case where hi-hat is assigned to the keys of the specific key range by the percussion instrument assigning portion, the musical tone generation controlling portion controls such that a musical tone signal to be generated by a depression of any key of the specific key range has a tone color of open hi-hat if the pedal is not operated, and the musical tone signal has a tone color of closed hi-hat if the pedal is operated.

* * * * *